United States Patent [19]

Honda et al.

[11] Patent Number: 4,645,729

[45] Date of Patent: Feb. 24, 1987

[54] METHOD FOR PREVENTING OFFSET IN ELECTROPHOTOGRAPHY

[75] Inventors: Nobuyasu Honda, Tenri; Masanori Fujii, Sakai; Masahiko Kubo, Tenri, all of Japan

[73] Assignee: Mita Industrial Co., Ltd., Osaka, Japan

[21] Appl. No.: 780,191

[22] Filed: Sep. 26, 1985

[30] Foreign Application Priority Data

Sep. 29, 1984 [JP] Japan ..... 59-202976

[51] Int. Cl.[4] ..... G03G 13/14

[52] U.S. Cl. ..... 430/126

[58] Field of Search ..... 430/99, 110, 126

[56] References Cited

U.S. PATENT DOCUMENTS 4,533,614 8/1985 Fukomoto ..... 430/99

FOREIGN PATENT DOCUMENTS 2815857 10/1978 Fed. Rep. of Germany ..... 430/110

*Primary Examiner*—John D. Welsh

*Attorney, Agent, or Firm*—Sherman and Shalloway

[57] ABSTRACT

A charged image on a photosensitive layer is developed with a toner containing a releasing agent and a hydroxycarboxylic acid complex salt to form a toner image. The toner image is then transferred to a receptor sheet and fixed to it. The use of a toner containing a specific hydroxycarboxylic acid complex salt brings about a marked advantage of widening a non-offset region to a higher temperature without impairing the antiblocking property, flowability and heat resistance of the toner.

12 Claims, 1 Drawing Figure

METHOD FOR PREVENTING OFFSET IN ELECTROPHOTOGRAPHY

BACKGROUND OF THE INVENTION

1. Field of the Invention

This invention relates to a method of preventing offset in electrophotography. More specifically, it relates to a method of preventing an offset phenomenon of a toner when a receptor sheet bearing a toner image on its surface is brought into contact with a hot roller to fix the toner image.

2. Description of the Prior Art

In heat fixing toner particles onto a copying paper sheet in electrophotography, the heat pressing method using a hot roller is advantageous in view of thermal efficiency, prevention of the occurrence of fire, and the fixing operation. Since an image of the toner particles come into contact with the surface of fixing rollers under heat and pressure, the toner particles partly adhere, and is transferred, to the surface of the fixing rollers (a so-called offset phenomenon), and is again transferred to the copying paper sheet to contaminate it.

To prevent such a defect, some methods have already been proposed. One typical method is to make the surface of the fixing rollers from a releasing and soil-resistant material such as a fluorine-containing resin and form a thin film of an offset preventing liquid such as a silicone oil on its surface. This method, however, has the disadvantage that the mechanism of the fixing device is complex and one has to take the trouble of using the offset preventing liquid in the fixing operation. Another typical method is to prevent the offset phenomenon by including a substance acting as a releasing agent such as a low-molecular-weight olefin resin into the toner particles, and liberate this substance in the form of a liquid on the surfaces of the particles at the time of fixing by rollers.

As will be clearly shown by an example given hereinafter, the latter method may be effective for heat fixing at relatively low temperature of less than 160° C., but it has been found that at high temperatures of more than 170° C., its offset preventing effect is not sufficient.

It is strongly desired to increase the temperature of a hot roller in the hot roller fixing method in order to make possible high-speed copying and to enable the use of a high softening point fixing resin which can be fixed at a high fixing temperature and therefore does not undergo blocking when used as a toner.

SUMMARY OF THE INVENTION

The present inventors have found that in a method of fixing a toner by contact with a hot roller, the inclusion of a releasing agent and a hydroxycarboxylic acid complex salt in the toner markedly widens a temperature range within which offset can be prevented to a high temperature side. It has further been found that the joint use of the hydroxycarboxylic acid complex salt enables the amount of the releasing agent to be decreased, and that partly because of the usability of a fixing resin having a high softening point, the blocking of the toner can be prevented and its flowability and heat resistance can be improved.

It is an object of this invention to provide an electrophotographic process in which the non-offset region can be widened to a high temperature side without impairing the anti-blocking property, flowability and heat resistance of a toner.

Another object of this invention' is to provide a method in which the aforesaid improvement can be achieved by a simple means of incorporating a hydroxycarboxylic acid complex salt into a toner.

According to this invention, there is provided, in an electrophotographic process comprising developing a charged image on a photosensitive layer with a chargeable toner to form a toner image, transferring the toner image from the photosensitive layer to a receptor sheet, and fixing it to the receptor sheet, a method of preventing offset which comprises using a toner composed of a fixing resin medium and a hydroxycarboxylic acid complex salt and a releasing agent dispersed therein as the chargeable toner and heat-fixing the toner image by contacting it with a hot roller.

Figure 1:
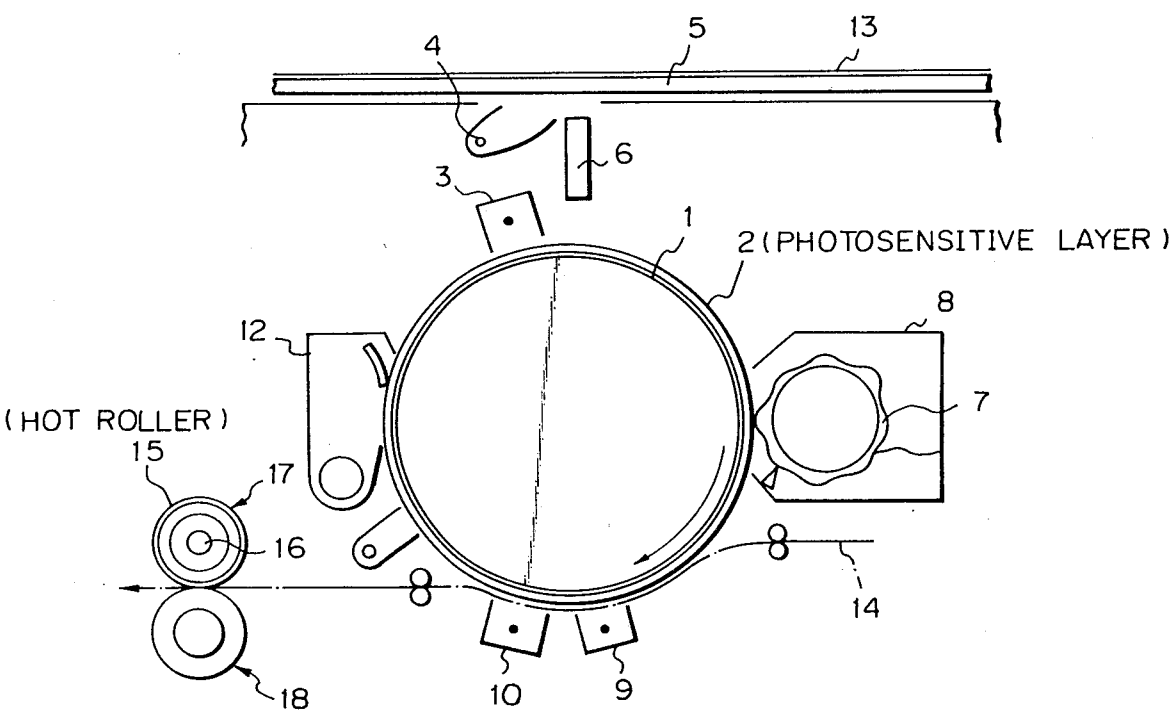
FIG. 1 is a view of a part of an electrostatic copying machine to which the present invention is applied.

DETAILED DESCRIPTION OF THE PREFERRED EMBODIMENTS (Electrophotographic Process)

Referring to FIG. 1 showing electrophotography to which the offset preventing method of this invention is applied, an electrophotographic layer 2 is formed on the surface of a rotating metal drum 1. Around the drum 1 are provided a corona discharger 3 for main charging, an image exposing mechanism comprised of a lamp 4, a document supporting transparent plate 5 and an optical system 6, a developing mechanism 8 having a toner 7, a corona discharger 9 for toner transfer, a corona discharger 10 for paper separation, a charge eliminating lamp 11, and a cleaning mechanism 12 in this order.

First, the photoconductor layer 2 is charged to a fixed polarity. Then, a document 13 to be copied is illuminated by the lamp 4, and through the optical system 6, the photoconductor layer 2 is exposed imagewise with the light image of the document to form a latent electrostatic image corresponding to the image of the document. The latent electrostatic image is then developed with the toner 7 by the developing mechanism 8. A receptor sheet 14 is supplied at the position of the discharger 9 for toner transfer so that it makes contact with the surface of the drum 1. By applying a corona discharge having the same polarity as the electrostatic image to the back of the receptor sheet 14, the toner image is transferred to the receptor sheet 14. The receptor sheet 14 having the toner image transferred thereto is electrostatically peeled from the drum 1 by the corona discharger 10 for paper separation, and sent to a fixing zone. In the fixing zone, there are provided a hot roller 17 having a polytetrafluoroethylene coated layer 15 on its surface and a heating mechanism 16 disposed inside and a press roller 18, and the receptor sheet bearing the toner image passes through the nipping position between the rollers 17 and 18, and the toner image is fixed to the receptor sheet by the heat from the hot roller 17.

There seem to be roughly the following two causes of the offset phenomenon which occurs at the time of fixing the toner image by the hot roller. One is that the toner particles are completely melted, but the force of the molten toner to stick to the roller is greater than the cohesive force of the molten toner, and consequently the toner is transferred to the surface of the roller (hot offset). The other is that the toner particles are melted on the hot roller but are not melted or softened on the receptor sheet, and consequently transferred to the roller surface (cold offset). When a region in which offset phenomenon occurs is plotted against the temperature of the roller and the time of contact with the roller at both axes in the heat-fixing of the toner with the hot roller, a hot offset region generally exists on a higher temperature side and a lower time side, and a cooled offset region exists on a lower temperature side and a shorter time side, and a non-offset fixing region exists between these regions. The size of the non-offset region varies with the type of the resin. The present invention is based on the new finding that the incorporation of a hydroxycarboxylic acid complex salt and a releasing agent into a toner markedly widens the non-offset fixing region to a higher temperature side.

(Toner Formulation)

The hydroxycarboxylic acid complex salt used in this invention is a complex salt formed between a hydroxycarboxylic acid and a transition metal such as iron, cobalt, nickel or chromium, and generally the hydroxycarboxylic acid and the metal exist in a ratio of 2:1. The hydroxycarboxylic acid complex salt is represented by the following general formula

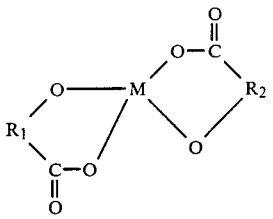

(1)

wherein $R_1$ and $R_2$ represent a residue of a hydroxycarboxylic acid, the hydroxyl group and the carboxyl group are bonded to the carbon atoms adjacent to $R_1$ and $R_2$, and M is a divalent transition metal, particularly iron, cobalt, nickel or chromium.

The hydroxycarboxylic acid component is desirably an aromatic hydroxycarboxylic acid, such as salicyclic acid, an alkyl-substituted salicyclic acid, 2-hydroxy-3-naphthoic acid, an alkyl-substituted 2-hydroxy-3-naphthoic acid of 5,6,7,8-tetrahydro-2-hydroxy-3-naphthoic acid. The two hydroxycarboxylic acid components in the complex salt may be identical or different. An especially preferred complex salt is 2:1 type cobalt 2-hydroxy-3-naphthoate.

The releasing agent used in this invention may be any known releasing agent having the ability to prevent offset. Examples of the releasing agent are low-molecular-weight olefin resins such as low-molecular-weight polypropylene and low-molecular-weight polyethylene; and various lubricant oils or waxes such as silicone oil, polyethylene wax, paraffin wax, montan wax, beeswax and carnauba wax.

The suitable amount of the releasing agent used in this invention is 1 to 25 parts by weight, particularly 3 to 15 parts by weight, per 100 parts by weight of the toner (excepting the releasing agent and hydroxycarboxylic acid complex). On the other hand, the suitable amount of the hydroxycarboxylic acid complex salt is 0.5 to 7 parts by weight, particularly 1 to 3 parts by weight, per 100 parts by weight of the toner (excepting the releasing agent and hydroxycarboxylic acid complex). When the amount of the releasing agent is smaller than the specified limit, it is difficult to widen the non-offset fixing region even by incorporating the hydroxycarboxylic acid complex salt. On the other hand, when it is larger than the above-specified limit, the toner has a tendency to blocking, and decreases in flowability and heat resistance. If the amount of the hydroxycarboxylic acid complex salt is smaller than the above-specified limit, the desired object of widening the non-offset fixing region to a higher temperature side is difficult to achieve sufficiently. If it is larger than the above-specified limit, no particular advantage is obtained over the amounts within the specified range, and it is economically disadvantageous. Furthermore, the electrophotographic properties, such as charging characteristics, of the toner may be adversely affected.

Fixing resins conventionally used in toners, such as styrene resins and acrylic resins, may be used in the toner used in this invention. A preferred fixing resin which remarkably widens the non-offset fixing region when combined with the above hydroxycarboxylic acid complex salt and releaseing agent is a copolymer of an aromatic vinyl compound and an ethylenically unsaturated carboxylic acid ester.

The aromatic vinyl compound may be represented by the following formula

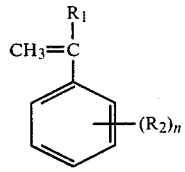

(2)

wherein $R_1$ represents a hydrogen atom, a lower ($C_4$ or less) alkyl group or a halogen atom, $R_2$ represents a substituent such as a lower alkyl group or a halogen atom, and n is an integer of not more than 2 including zero.

Specific examples include styrene, vinyltoluene, alphamethyl-styrene, alpha-chlorostyrene, vinylxylene and vinylnaphthalene.

The ethylenically unsaturated monocarboxylic acid ester may be an alkyl ester of an ethylenically unsaturated monocarboxylic acid represented by the following formula

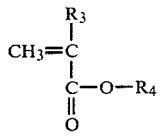

(3)

wherein $R_3$ represents a hydrogen atom or a lower alkyl group, and $R_4$ is an alkyl group having up to 18 carbon atoms.

Specific examples of the alkyl ester of an ethylenically unsaturated monocarboxylic acid include ethyl acrylate, methyl methacrylate, butyl acrylate, butyl methacrylate, 2-ethylhexyl acrylate and 2-ethylhexyl methacrylate.

Fixing resins especially suitable for the object of this invention are resins prepared by copolymerizing styrene or vinyltoluene with an acrylate or methacrylate in a weight ratio of from 50:50 to 80:20, particularly from 60:40 to 75:25. Preferred are those prepared from styrene or vinyltoluene and a mixture of an acrylate or methacrylate having an alkyl group with not more than 4 carbon atoms and an acrylate or methacrylate having an alkyl group with at least 6 carbon atoms, the weight ratio in the acrylate or methacrylate mixture being from 5:95 to 90:10, particularly from 10:90 to 85:15.

Examples of preferred copolymers used in this invention are styrene/butyl acrylate/2-ethylhexyl acrylate copolymer, styrene/ethyl acrylate/2-ethylhexyl methacrylate copolymer, styrene/butyl methacryrlate/2-ethylhexyl acrylate copolymer, styrene/butyl methacrylate/decyl acrylate copolymer, styrene/butyl acrylate/2-ethylhexyl acrylate copolymer, styrene/butyl acrylate/butyl methacrylate/2-ethylhexyl acrylate copolymer and vinyltoluene/butyl methacrylate/2-ethylhexyl acrylate.

The copolymer desirably has a weight average molecular weight of at least 2,000 and a softening point (ring-and ball method) in the range of 70° to 200° C.

In addition to the aforesaid components, the toner used in this invention further comprises a pigment which is at least one of a coloring pigment, a magnetic pigment, a body pigment, a magnetic pigment and an electrically conductive pigment. The pigment may concurrently have at least two of the functions stated above. For example, carbon black has the functions of a black pigment and an electrically conductive pigment. Tri-iron tetroxide has the function of a magnetic pigment, and as its common name "black iron oxide" suggests, also has the function of a black pigment.

Suitable examples of the colored pigment are as follows.

Black pigments: carbon black, acetylene black, lamp black, and aniline black.

Yellow pigments: Chrome yellow, zinc yellow, cadmium yellow, yellow iron oxide, mineral fast yellow, nickel titanium yellow, Naple's yellow, Naphthol Yellow 10G, Hansa Yellow G, Benzidine Yellow G, Hansa Yellow 10G, Benzidine Yellow GR, Quinoline Yellow Lake, Permanent Yellow NCG, and Tartrazine Yellow Lake.

Orange pigments: Chrome Orange, molybdene orange, permanent orange GTR, pyrazolone orange, Vulcan Orange, indanthrene brilliant orange RK, Benzidine Orange G, and Indanthrene Brilliant Orange GK.

Red pigments: Red iron oxide, cadmium lead, lead red, cadmium mercury sulfide, Permanent Red 4R, Pyrazolone Red, Watching Red Calcium salt, Lake Red D, Brilliant Carmine 6B, Eoxine Lake, Rhodamine Lake B, Alizarin Lake and Brilliant Carmine 3B.

Purple pigments: Manganese violet, Fast Violet B and Methyl Violet Lake.

Blue pigments: Ultramarine, Cobalt Blue, Alkali Blue Lake, Victoria Blue Lake, Phthalocyanine Blue, non-methallic phthalocyanine blue, partly chlorinated product of Phthalocyanine Blue, Fast Sky Blue and Indanthrene Blue BC.

Green pigments: Chrome Green, chromium oxide, Pigment Green G, Malachite Green Lake, and Fanal Yellow Green G.

White pigments: Zinc flower, titanium oxide, antimony white and zinc sulfide.

Body pigments: Baryte powder, barium carbonate, clay, silica, white carbon, talc and alumina white.

Previously known magnetic pigments include, for example, tri-iron tetroxide ($Fe_3O_4$), triiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadlinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFeO_3$), barium iron oxide ($BaFe_{12}O_{19}$), magnesium iron oxide ($MgFe_2O_4$), lanthanum iron oxide ($LaFeO_3$), iron powder (Fe), cobalt power (Co), and nickel powder (Ni). In the present invention, too, fine powders of these known magnetic materials may be used. Triiron tetroxide is an especially preferred magnetic pigment.

As the electrically conductive pigment, the aforesaid carbon blacks themselves, and various inorganic powders which are non-conductive but have been subjected to a treatment of rendering them electrically conductive, or various metal powders may be used.

The amount of the pigment to be incorporated may be varied over a wide range depending upon the use of the toner, and is generally within the range of 1 to 300% by weight based on the amount of the fixing resin. For a two-component developer, namely for a toner to be combined with a magnetic carrier, the colored pigment is desirably used in an amount of 1 to 15% by weight, especially 2 to 10% by weight, based on the amount of the fixing agent. For a one-component magnetic toner, the magnetic pigment is desirably used in an amount of 50 to 33% by weight, particularly 60 to 250% by weight, based on the amount of the fixing resin, in combination with the colored pigment or the electrically conductive pigment, if desired.

Known additives may be incorporated into the toner used in this invention in accordance with known formulations. For example, as a chargeable toner, it is possible to incorporate 0.1 to 5% by weight, based on the amount of the fixing agent, of a known charge controlling agent, for example an oil-soluble dye such as nigrosine base (CI 5045), Oil Black (CI 26150), a metal naphthenate, fatty acid metal soaps, resin acid soaps or a metal-containing azo dye.

The toner may be obtained by kneading the aforesaid copolymer and the pigment, cooling the kneaded mixture, pulverizing it, and sieving it as desired. Mechanical rapid stirring may be carried out without any particular problem in order to round out angular portions of irregularly-shaped particles.

Desirably, the particle size of the toner particles is generally in the range of 5 to 35 microns, although it has to do with resolving power, etc.

In an electrostatographic process using the toner in accordance with this invention, a latent electrostatic image may be formed by any desired method. For example, a photoconductor layer on an electrically conductive substrate is uniformly charged and then imagewise exposed to form a latent electrostatic image.

The electrostatic image can be easily developed by contacting a magnetic brush of the toner which is used as such as a one-component magnetic toner or as a two-component toner in admixture with a magnetic carrier with the image-bearing surface of the photoconductor layer. The toner image formed as a result of the development is transferred to a receptor sheet and by being contacted with a hot roll, is fixed to the receptor sheet.

ADVANTAGE OF THE INVENTION

In the present invention, the use of a toner of the aforesaid composition and the hot roll fixing method achieves the marked advantage that the non-offset fixing region is widened to a higher temperature side, and consequently, the fixing operation becomes rapid to permit high-speed copying and also a fixing resin having a high softening point can be used. In addition, this advantage can be achieved by using a relatively small amount of the releasing agent, and therefore, the anti-blocking property, flowability and heat resistance of the toner are further improved.

The temperature at which the hot roller is to be set varies depending upon the type or properties of the fixing resin and cannot be generalized. It is to be noted however that according to this invention, the upper limit temperature of the non-offset fixing region can be generally elevated by at least 50° C., and at least 30° C. as compared with the use of a toner not containing the hydroxycarboxylic acid complex salt, and heating of the hot roll to this increased upper limit can be done.

EXAMPLES

The excellent advantages of this invention will be illustrated by the following examples.

EXAMPLE 1

| Preparation of a developer | |
|---|---|
| Styrene/acrylic resin (XPA-525, a product of Mitsui Toatsu Chemicals, Inc.) | 90 parts by weight |
| Low-molecular-weight polypropylene (Viscol 550 P, a product of Sanyo Chemical Co., Ltd.) | 2 parts by weight |
| Carbon Black (Pringtex L, a product of Degussa Co.) | 6 parts by weight |
| Charge controlling agent (chromium-containing azo dye, Bontron S-34, a product of Hodogaya Chemical Co., Ltd.) | 1.5 parts by weight |
| Hydroxycarboxylic acid complex salt of the following formula: | 1.5 parts by weight |

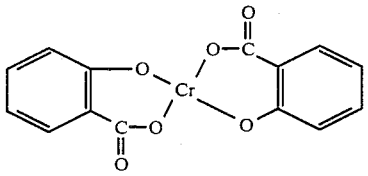

The above materials were melt-kneaded by a twin-screw extruder, cooled and then coarsely pulverized to a size of less than 2 mm by a cutting mill. The pulverized mixture was then finely pulverized by an ultrasonic jet mill fine pulverizer, and particles having a particle diameter of less than 5 micrometers were removed by an Alpine dispersing machine to obtain particles having an average particle diameter of 11.5 micrometers. Then, 0.5% of hydrophobic fine silica particles (R-972, a product of Japan Aerosil Co., Ltd.) was added to improve flowability and to form a black toner.

Twenty-five grams of the resulting black toner was mixed with 450 g of an iron powder carrier (Diablone 402S, a product of Mitsubishi Chemical Co., Ltd.) to form a developer.

COPYING TEST

Using the resulting developer, a copying test was conducted in a commercial electrostatic copying machine (DC-161, a product of Mita Industrial Co., Ltd.).

The fixing device was used under the following conditions.

Upper roller: Teflon roller
Lower roller: silicone roller
Sheet feeding speed: 75 mm/sec
non silicone oil was used
Fixing temperature: variable between 150° and 220° C.

In the above device, the fixing temperature was raised by 10° C. increments from 160° C., and the state of an image formed at each time was observed.

The results are shown in Table 1.

COMPARATIVE EXAMPLE 1

The same test as in Example 1 was carried out except that the hydroxycarboxylic acid complex salt was not used in the preparation of the toner. The results are shown in Table 1.

EXAMPLE 2

| | |
|---|---|
| Styrene/acrylic resin (SBM-73, a product of Sanyo Chemical Co., Ltd.) | 90 parts by weight |
| Low-molecular-weight polypropylene (Viscol 550 P, a product of Sanyo Chemical Co., Ltd.) | 2 parts by weight |
| Red pigment (Monoazo Lake, a product of Sanyo Shikiso Co., Ltd.) | 6 parts by weight |
| Oil-soluble dye (Spiron Red GRLH Special, a product of Hodogaya Chemical Co., Ltd.) | 0.5 parts by weight |
| Compound of the following formula: | 1.5 parts by weight |

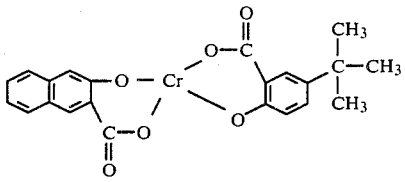

A red toner was prepared from the above materials in the same way as above, and then mixed with an iron powder carrier to form a developer.

Using this developer, the same copying test as in Example 1 was carried out. The results are shown in Table 1.

COMPARATIVE EXAMPLE 2

The same experiment as in Example 2 was carried out except that the hydroxycarboxylic acid complex salt was not used in the preparation of the toner. The results are shown in Table 1.

EXAMPLE 3

| | |
|---|---|
| Styrene/acrylic copolymer (Pliolite ACG, a product of Goodyear Co.) | 55 parts by weight |
| Ethylene/vinyl acetate copolymer (Evaflex 420, a product of Mitsui Polychemical Co., Ltd.) | 2 parts by weight |
| Low-molecular-weight polypropylene (Viscol 550 P, a product of Sanyo Chemical Co., Ltd.) | 8 parts by weight |
| Tri-iron tetroxide (Black Iron BM611, a product of Toyo Shikiso Co., Ltd.) | 35 parts by weight |
| Compound of the following formula | 3 parts by weight |

-continued

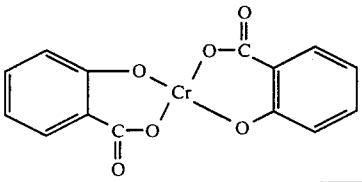

The above materials were kneaded, pulverized and classified in the same way as in Example 1 to form a one-component magnetic toner having an average particle diameter of 12 microns.

A copying test was carried out by using the same copying machine as used in Example 1 which, however, was remodelled to adapt it for use with a one-component developer.

The results are shown in Table 1.

COMPARATIVE EXAMPLE 3

The same experiment as in Example 3 was carried out except that the hydroxycarboxylic acid complex salt was not used in toner preparation. The results are shown in Table 1.

TABLE 1

| Example (Ex.) of Comparative Example (CEx.) | Image Density | Fog Density | Flowability | Fixability | Offset Resistance (°C.) 160 | 170 | 180 | 190 | 200 | 210 |
|---|---|---|---|---|---|---|---|---|---|---|
| Ex. 1 | 1.33 | 0.003 | | | | | | | | Δ |
| CEx. 1 | 1.29 | 0.009 | | | | Δ | X | X | X | X |
| Ex. 2 | 1.27 | 0.001 | | | | | | | Δ | X |
| CEx. 2 | 1.31 | 0.006 | | | | Δ | X | X | X | X |
| Ex. 3 | 1.45 | 0.002 | | | | | | | Δ | X |
| CEx. 3 | 1.38 | 0.007 | | | | | Δ | X | X | X |

Flowability and fixability
: Particulary good, : Good, Δ: Slightly good, X: Poor
Offset resistance
: Offset did not occur, Δ: Offset occurred slightly, X: Offset occurred remarkably.

What is claimed is:

1. In an electrophotographic process, including the steps of developing a charged image on a photosensitive layer with a chargeable toner to form a toner image, transferring the toner image from the photosensitive layer to a receptor sheet, and fixing the toner image to the receptor sheet, the improvement which comprises using as the chargeable toner a toner comprising (i) a fixing resin medium which is a copolymer of an aromatic vinyl compound and an ethylenically unsaturated carboxylic acid ester, (ii) 0.5 to 7% by weight, based on the weight of the toner, of a hydroxycarboxylic acid complex salt, and (iii) 1 to 25% by weight, based on the weight of the toner, of a releasing agent, and heat-fixing the toner image by contacting it with a hot roller, whereby the non-offset region is widened on the high temperature side such that offset is prevented.

2. The method of claim 1 wherein the toner contains 0.5 to 6.6% by weight of the hydroxycarboxylic acid complex salt and 1 to 20% by weight of the releasing agent.

3. The method of claim 1 or 2 wherein the hydroxycarboxylic acid complex salt is a compound represented by the following general formula

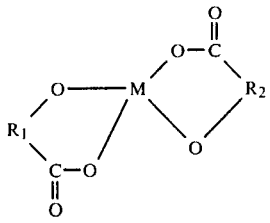

wherein $R_1$ and $R_2$ represent a residue of a hydroxycarboxylic acid, the hydroxyl group and the carboxyl group are bonded to the carbon atoms adjacent to $R_1$ to $R_2$, and M is a divalent transition metal, particulary iron, cobalt, nickel or chromium.

4. The method of claim 3 wherein the hydroxycarboxylic acid component of said complex salt is an aromatic hydroxycarboxylic acid.

5. The method of claim 4 wherein the hydroxycarboxylic acid complex salt is cobalt 2-hydroxy-3-naphthoate.

6. The method of claim 1 wherein the aromatic vinyl compound is represented by the following formula

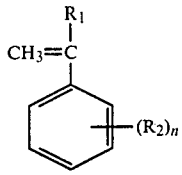

wherein $R_1$ represents a hydrogen atom, a lower ($C_4$ or less) alkyl group or a halogen atom, $R_2$ represents a substituent such as a lower alkyl group or a halogen atom, and n is an integer of not more than 2 including zero.

7. The method of claim 1 wherein the ethylenically unsaturated carboxylic acid ester is represented by the following formula

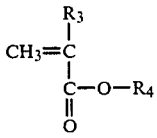

wherein $R_3$ represents a hydrogen atom or a lower alkyl group, and $R_4$ is an alkyl group having up to 18 carbon atoms.

8. The method of claim 1 wherein the hot roller has a fixing temperature of from 160° to 200° C.

9. The method of claim 1 wherein the toner comprises 1 to 3 parts by weight, based on the weight of the toner, of the hydroxycarboxylic acid's complex salt and from 3 to 15% by weight, based on the weight of the toner, of the releasing agent.

10. The method of claim 1 wherein the fixing resin medium is a copolymer of an aromatic vinyl compound selected from the group consisting of styrene, vinyl toluene, alphamethyl-styrene, alpha-chloro-styrene, vinylxylene and vinyl naphthalene and an ethylenically unsaturated carboxylic acid ester selected from the group consisting of ethylacrylate, methylmethacrylate, butylacrylate, butylmethacrylate, 2-ethylhexylacrylate, and 2-ethylhexylmethacrylate.

11. The method of claim 10 wherein the copolymer has a weight average molecular weight of at least 2000 and a softening point by the ring-and-ball method in the range of 70° to 200° C.

12. The method of claim 1 wherein the toner further comprises a pigment selected from the group consisting of coloring pigment, magnetic pigment, body pigment, electrically conductive pigment, and mixtures thereof.

* * * * *